US009187238B2

(12) United States Patent
Claussen

(10) Patent No.: US 9,187,238 B2
(45) **Date of Patent: *Nov. 17, 2015**

(54) BULK MATERIAL STORAGE APPARATUS

(71) Applicant: Alternative Energy, Inc., Willmar, MN (US)

(72) Inventor: Steven W. Claussen, Glenwood, MN (US)

(73) Assignee: CLAUSSEN TECHNOLOGY, LLC, Naples, FL (US)

( * ) Notice: Subject to any disclaimer, the term of this patent is extended or adjusted under 35 U.S.C. 154(b) by 249 days.

This patent is subject to a terminal disclaimer.

(21) Appl. No.: 13/889,138

(22) Filed: May 7, 2013

(65) Prior Publication Data

US 2013/0243553 A1 Sep. 19, 2013

Related U.S. Application Data

(63) Continuation of application No. 12/955,247, filed on Nov. 29, 2010, now Pat. No. 8,434,990.

(60) Provisional application No. 61/266,046, filed on Dec. 2, 2009.

(51) Int. Cl.

| | |
|---|---|
| ***B65D 88/30*** | (2006.01) |
| ***B65D 88/26*** | (2006.01) |
| ***B65D 88/32*** | (2006.01) |
| ***B65D 90/14*** | (2006.01) |

(52) U.S. Cl.

CPC ..... *B65D 88/30* (2013.01); *B65D 88/26* (2013.01); *B65D 88/32* (2013.01); *B65D 90/14* (2013.01); *B65D 2588/12* (2013.01)

(58) Field of Classification Search

CPC ..... B60P 1/6427; B60P 1/6445; B65D 88/30
USPC ..... 414/332, 498; 254/89 R, 90, 92, 89 H
See application file for complete search history.

(56) References Cited

U.S. PATENT DOCUMENTS

| | | | |
|---|---|---|---|
| 1,425,965 | A | 8/1922 | Hocke |
| 2,670,866 | A | 3/1954 | Glesby |
| 2,678,737 | A | 5/1954 | Mangrum |
| 3,119,503 | A | 1/1964 | Herpich et al. |
| 3,255,906 | A | 6/1966 | Proler et al. |
| 3,462,123 | A | 8/1969 | Oliver |
| 3,474,924 | A | 10/1969 | Wheeler |
| 3,520,433 | A | 7/1970 | Blackburn |
| 3,612,315 | A | 10/1971 | Blackburn |
| 3,758,074 | A | 9/1973 | Jeffries et al. |
| 4,053,073 | A | 10/1977 | Franchin |
| 4,076,299 | A | 2/1978 | Dalton |

(Continued)

OTHER PUBLICATIONS

U.S. Appl. No. 61/266,046, filed Dec. 2, 2009, Claussen.

(Continued)

*Primary Examiner* — Jonathan Snelting
(74) *Attorney, Agent, or Firm* — Mueting Raasch & Gebhardt, P.A.

(57) ABSTRACT

Bulk material storage apparatus including adjustable leg members and lift apparatuses and methods of using such apparatus. The bulk material storage apparatus may include one or more containers, each of the one or more containers defining a volume for holding a bulk material, and a frame to support the one or more containers.

17 Claims, 10 Drawing Sheets

(56) References Cited

U.S. PATENT DOCUMENTS

| | | | |
|---|---|---|---|
| 4,313,708 | A | 2/1982 | Tiliakos |
| 4,522,550 | A | 6/1985 | Whitehouse |
| 4,903,946 | A | 2/1990 | Stark |
| 5,417,540 | A | 5/1995 | Cox |
| 5,624,225 | A | 4/1997 | Cox |
| 5,743,701 | A | 4/1998 | Green |
| 6,071,062 | A | 6/2000 | Warhurst et al. |
| 6,309,169 | B1 | 10/2001 | Carlile |
| 6,532,398 | B2 | 3/2003 | Matsumoto |
| 6,537,015 | B2 | 3/2003 | Lim et al. |
| 7,100,896 | B1 | 9/2006 | Cox |
| 8,434,990 | B2 | 5/2013 | Claussen |
| 2009/0129903 | A1 | 5/2009 | Lyons |

OTHER PUBLICATIONS

"About PODS—Moving & Storage made easy," datasheet [online]. PODS Enterprises, Inc., Clearwater, FL, © 2006-2009 [retrieved on May 20, 2009]. Retrieved from the Internet:<URL:http://www.pods.com/about-pods.aspx>; 3 pgs.

"flxtor Bulk Seed Delivery Systems—Patent Pending," Description [online]. USC, LLC, Sabetha, KS [retrieved on Jun. 17, 2009]. Retrieved from the Internet:<URL:http://www.uscllc.com/index.php?1=flxtor2>; 1 page.

"New Efficient Bulk Seed Delivery System," Product Brochure [online]. USC, LLC, Sabetha, KS [retrieved on Jun. 17, 2009]. Retrieved from the Internet:<URL:http://www.uscllc.com/brochures/flXtor-bsd.pdf>; 4 pgs.

BULK MATERIAL STORAGE APPARATUS

CROSS-REFERENCE TO RELATED APPLICATION

This application is a continuation of U.S. patent application Ser. No. 12/955,247, filed on Nov. 29, 2010, which claims the benefit of U.S. Provisional Application Ser. No. 61/266,046, filed Dec. 2, 2009, each of which are incorporated herein by reference in their entireties.

BACKGROUND

The disclosure herein relates to bulk material storage apparatus, and further to methods of using such apparatus.

Bulk material, e.g., seed, fertilizer, grain, cement, raw material, liquid, etc., may be stored in many different types of apparatus. Often, such apparatus includes a container and a frame to support the container above a ground surface. Due, in part, to the size and weight of the apparatus (e.g., when holding a bulk material), the transport of such apparatus may be complicated.

Various attempts have previously been made to create a bulk material storage apparatus that is more easily transported. For example, a bulk material storage apparatus has been created that is transportable using a specialized, narrow-width trailer (i.e., the trailer bed is 90 inches wide to accommodate the storage apparatus) and loadable/unloadable using a fork lift or a specialized seed tender including a hydraulic lift.

SUMMARY

The disclosure herein relates generally to bulk material storage apparatus and further to methods of using such apparatus. For example, as described herein, in one or more embodiments, the bulk material storage apparatus may include adjustable legs, e.g., to support the apparatus on a ground surface, and lift apparatus, e.g., to support and/or lift the apparatus from an elevated surface (e.g., a trailer bed).

One exemplary bulk material storage apparatus disclosed herein is operable to be transported on a trailer bed and stationed on a ground surface. The apparatus includes one or more containers and a frame to support the one or more containers. Each of the one or more containers defines a volume for holding a bulk material and each of the one or more containers includes a lower portion and an upper portion. The lower portion includes a discharge opening for discharging the bulk material from the container and the upper portion includes a load opening for loading the bulk material into the container.

The frame includes first, second, third, and fourth leg members spaced apart about a perimeter of the apparatus, a plurality of cross members, and at least first, second, third, and fourth lift apparatuses (e.g., manually-operable jacks). The first and second leg members define a first frame plane along a first side of the apparatus and the third and fourth leg members define a second frame plane along a second side of the apparatus opposite the first side of the: apparatus (e.g., the distance between the first frame plane and the second frame plane may be greater than 102 inches). Each of the first, second, third, and fourth leg members includes an upper leg portion and a lower leg portion. The upper leg portion extends from a bottom end region to a top end region along a vertical axis and the top end region is located adjacent the one or more containers. The lower leg portion includes a foot member operable to engage the ground surface. Further, the lower leg portion is adjustably coupled to the bottom end region of the upper leg portion for adjustment along the vertical axis between at least a retracted position and an extended position. The foot member is operable to engage the ground surface to support the apparatus on the ground surface when the lower leg portion is in the extended position and is located closer to the bottom end region of the upper leg portion when the lower leg portion is in the retracted position than when the lower leg portion is in the extended position. Each of the plurality of cross members extends from a first end region to a second end region and between two of the first, second, third, and fourth leg members to support the first, second, third, and fourth leg members as spaced apart about the perimeter of the apparatus.

Each of the first, second, third, and fourth lift apparatuses includes a fixed portion and a lift member. The fixed portion is coupled to at least one of the plurality of cross members and the upper leg portions of the first, second, third, and fourth leg members proximate a corresponding leg member of the first, second, third, and fourth leg members, respectively. The lift member includes an engaging member operable to engage the trailer bed and is adjustably coupled to the fixed portion for adjustment along a vertical axis between at least a non-advanced position and an advanced position. The engaging member engages the trailer bed to support the apparatus on the trailer bed when the lift member is in the advanced position. Further, the lift member is offset from one of and located between the first frame plane and the second frame plane. The first lift apparatus may be operably coupled to the third lift apparatus such that the lift members of the first and third lift apparatuses are simultaneously adjustable, and the second lift apparatus may also be operably coupled to the fourth lift apparatus such that the lift members of the second and fourth lift apparatuses are simultaneously adjustable.

The bulk material storage apparatus is configurable in at least a transport configuration, a first transition configuration, a second transition configuration, and a stationary configuration. The lower leg portion of each of the first, second, third, and fourth leg members is in the retracted position, the lift member of each of the first, second, third, and fourth lift apparatuses is in the non-advanced position, and at least a portion of the frame is operable to engage the trailer bed to support the apparatus on the trailer bed when the apparatus is in the transport configuration. Further, the lower leg portion of each of the first, second, third, and fourth leg members is in the retracted position and the lift member of each of the first, second, third, and fourth lift apparatuses is in the advanced position operable to engage the trailer bed with the engaging member to support the apparatus on the trailer bed when the apparatus is in the first transition configuration. Still further, the lower leg portion of each of the first, second, third, and fourth leg members is in the extended position operable to engage the ground surface with the foot member to support the apparatus on the ground surface and the lift member of each of the first, second, third, and fourth lift apparatuses is in the advanced position operable to engage the trailer bed with the engaging member to support the apparatus on the trailer bed when the apparatus is in the second transition configuration. Yet still further, the lower leg portion of each of the first, second, third, and fourth leg members is in the extended position operable to engage the ground surface with the foot member to support the apparatus on the ground surface and the lift member of each of the first, second, third, and fourth lift apparatuses is in the non-advanced position when the apparatus is in the stationary configuration.

Another exemplary bulk material storage apparatus disclosed herein includes one or more containers and a frame to support the one or more containers. Each of the one or more containers defines a volume for holding a bulk material and includes a lower portion and an upper portion. The lower portion includes a discharge opening for discharging the bulk material from the container, and the upper portion includes a load opening for loading the bulk material into the container.

The frame includes first, second, third, and fourth leg members spaced apart about a perimeter of the apparatus, a plurality of cross members, and at least first, second, third, and fourth lift apparatuses. The first and second leg members define a first frame plane along a first side of the apparatus and the third and fourth leg members define a second frame plane along a second side of the apparatus opposite the first side of the apparatus. Each of the first, second, third, and fourth leg members includes an upper leg portion and a lower leg portion. The upper leg portion extends from a bottom end region to a top end region along a vertical axis and the top end region is located adjacent the one or more containers. The lower leg portion includes a foot member operable to engage a surface and is adjustably coupled to the bottom end region of the upper leg portion for adjustment along the vertical axis between at least a retracted position and an extended position. The foot member is operable to engage the surface to support the apparatus on the surface when the lower leg portion is in the extended position, and the foot member is located closer to the bottom end region of the upper leg portion when the lower leg portion is in the retracted position than when the lower leg portion is in the extended position. Each of the plurality of cross members extends from a first end region to a second end region and between two of the first, second, third, and fourth leg members to support the first, second, third, and fourth leg members as spaced apart about the perimeter of the apparatus.

Each of the first, second, third, and fourth lift apparatuses includes a fixed portion and lift member. The fixed portion is coupled to at least one of the plurality of cross members and the upper leg portions of the first, second, third, and fourth leg members proximate a corresponding leg member of the first, second, third, and fourth leg members, respectively. The lift member includes an engaging member and is adjustably coupled to the fixed portion for adjustment along a vertical axis between at least a non-advanced position and an advanced position. Further, the lift member is offset from one of and located between the first frame plane and the second frame plane.

One exemplary method of unloading a bulk material storage apparatus from a trailer bed to a ground surface includes providing a bulk material storage apparatus on the trailer bed and adjusting the lift member of each of the first, second, third, and fourth lift apparatuses into the advanced position to engage the trailer bed with the engaging member to lift the apparatus from the trailer bed. The method further includes adjusting the lower leg portion of each of the first, second, third, and fourth leg members into the extended position, and adjusting the lift member of each of the first, second, third, and fourth lift apparatuses into the non-advanced position to lower the foot portion of the lower leg portion of each of the first, second, third, and fourth leg members to engage the ground surface to support the apparatus on the ground surface. Adjusting the lift member of each of the first, second, third, and fourth lift apparatuses into the advanced position may include adjusting the lift members of the first and third lift apparatuses simultaneously and adjusting the lift members of the second and fourth lift apparatuses simultaneously. The method may further include using at least a portion of the frame to support the apparatus on the trailer bed with bottom end regions of the upper leg portions of the first, second, third, and fourth leg members located alongside the trailer bed.

The above summary is not intended to describe each embodiment or every implementation of the present disclosure. A more complete understanding will become apparent and appreciated by referring to the following detailed description and claims taken in conjunction with the accompanying drawings.

DETAILED DESCRIPTION OF EXEMPLARY EMBODIMENTS

Figure 1:
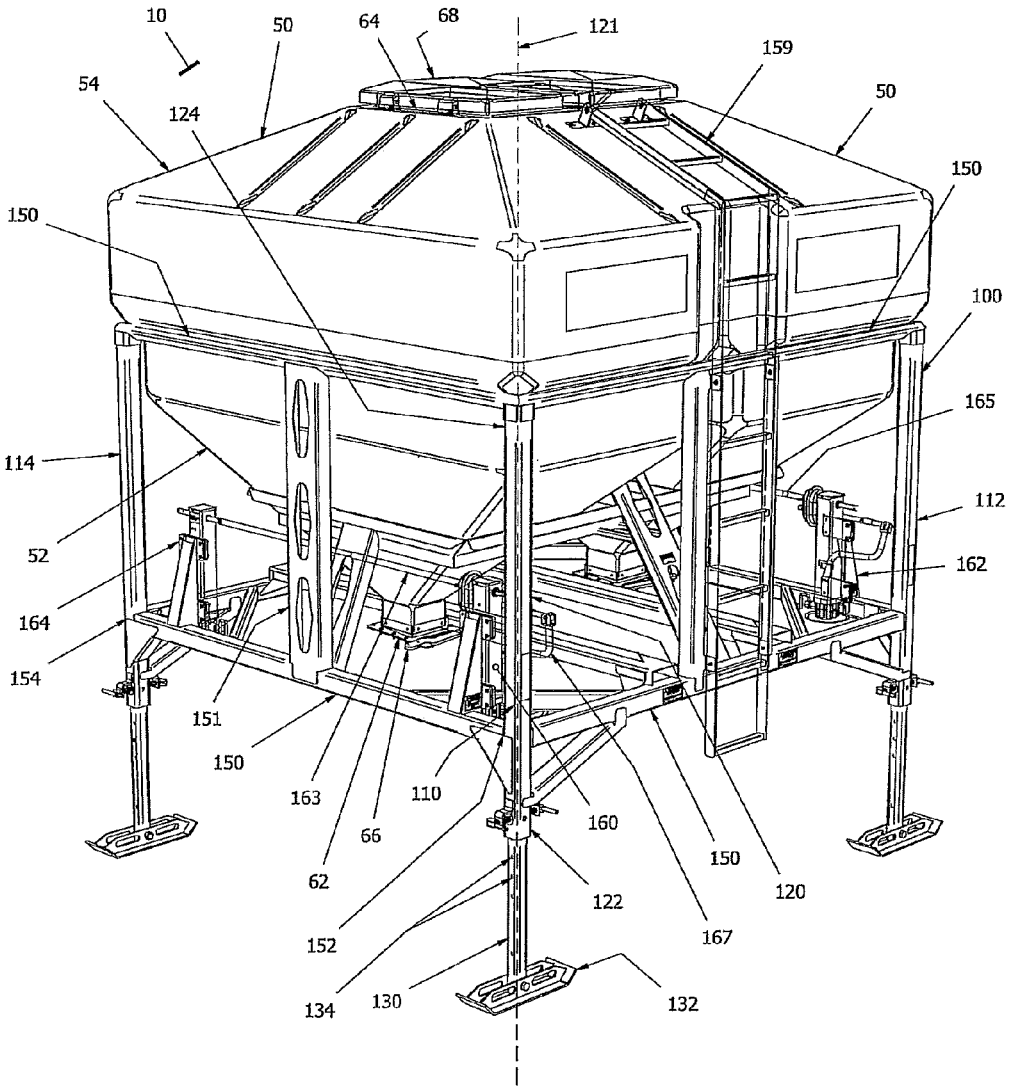
FIG. 1 is an illustrative perspective view of one exemplary embodiment of a bulk material storage apparatus.

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing from (e.g., still falling within) the scope of the disclosure presented hereby.

Exemplary apparatus, and methods of using such apparatus, shall be described with reference to FIGS. 1-8. It will be apparent to one skilled in the art that elements from one embodiment may be used in combination with elements of the other embodiments, and that the possible embodiments of such apparatus using combinations of features set forth herein is not limited to the specific embodiments shown in the Figures and/or described herein. Further, it will be recognized that the embodiments described herein may include many elements that are not necessarily shown to scale. Still further, it will be recognized that the size and shape of various elements herein may be modified but still fall within the scope of the present disclosure, although one or more shapes and/or sizes, or types of elements, may be advantageous over others.

FIGS. 1-4 show one exemplary embodiment of a bulk material storage apparatus 10 that includes two containers 50 and a frame 100 and defines a perimeter 16. Although the depicted embodiment of the bulk material storage apparatus 10 includes two containers 50, the apparatus 10 may include less than or more than two containers (e.g., in other words, the apparatus 10 may include one or more containers 50). Each of the containers 50 may be substantially the same, and as such, depending on the context, only a single container 50 will be described in more detail hereinafter. Further, it is to be understood that any description of a container 50 applies to any and all containers 50.

The container 50 defines a volume for holding a bulk material. As used herein, "bulk material" may include any material that may be transported and/or stored in bulk, e.g., seed, fertilizer, grain, cement, raw material, liquid, etc. In at least one embodiment, the container 50 defines a volume of 250 seed units.

Further, the container 50 includes a lower portion 52 and an upper portion 54. As depicted, the container 50 is rectangular-shaped and portions of the lower and upper portions 52, 54 include slanted or angled surfaces (e.g., tapered surfaces). In other embodiments, the container 50 may be any shape to, e.g., facilitate the bulk material to be contained therein. For example, the container 50 may be circular-shaped, elliptically-shaped, square-shaped, octagonally-shaped, trapezoidally-shaped, spherically-shaped, etc. A perimeter of the one or more containers 50 may be proximate the perimeter 16 of apparatus 10 to, e.g., maximize the volumes of the one or more containers 50.

The lower portion 52 includes a discharge opening 62 arranged along a vertical discharge axis 59 that may be used for discharging bulk material from the container (e.g., from the volume defined by the container 50). Further, the lower portion 52 optionally includes a gate member 66 for selectively closing the discharge opening 62 of the lower portion 52. As shown, at least part of the lower portions 52 may be tapered to assist in discharging the bulk material.

The upper portion 54 includes a load opening 64 that may be used for loading bulk material into the container 50 (e.g., into the volume defined by the container 50). Further, the upper portion 54 optionally includes a lid member 68 for selectively covering the load opening 64 of the upper portion 54 (e.g., to protect the bulk material from rain, dust, insects, etc.).

Although not described herein, the container 50 may further include any structure and/or apparatus generally associated with bulk material storage containers, e.g., a seed ladder, etc. Further, the container 50 may be formed of any one or more materials operable to store bulk material and to be supported by the frame 100. For example, the container 50 may be formed of a metal (e.g., steel, aluminum, etc.), a polymer (e.g., polyethylene, nylons, low density polyethylene (LDPE), linear low density polyethylene (LLDPE), polypropylene, ethylene vinyl acetate (EVA), polyvinyl chloride (PVC), etc.), fiber glass, carbon fiber, etc. Although, as depicted, the container 50 is separate from the frame 100, the container 50 and the frame 100 may be integral. For example, the container 50 and the frame 100 may be a single, continuous piece. Further, the container 50 and the frame 100 may be not be completely integral or separate, and as such, may share some of the same structures.

Further, the container 50 may be formed of single part construction. In other words, the container 50 may be a single, continuous piece. Also, an inner surface of the container 50 (not shown), i.e., defining the volume of the container, may be smooth to, e.g., allow for improved drainage, cleanout, discharge, etc. At least in one embodiment, the container 50 may be formed using rotational molding techniques.

The frame 100 supports the one or more containers 50, e.g., on and above a surface (e.g., a ground surface, an elevated surface, etc.), and includes at least four leg members (e.g., first leg member 110, second leg member 112, third leg member 114, and fourth leg member 116 as depicted in the figures), a plurality of cross members 150, and at least first, second, third, and fourth lift apparatuses (e.g., first lift apparatus 160, second lift apparatus 162, third lift apparatus 164, and fourth lift apparatus 166 as depicted in the figures). As used herein, a "ground surface" may be any surface located at a ground level, e.g., an earthen surface, a road surface, etc. As used herein, an "elevated surface" may be any surface located above a ground level, e.g., a trailer bed, a train car bed, a truck bed, etc.

Using only the components of the frame 100, the frame 100 may be loaded from a ground surface onto an elevated surface for transportation and unloaded from the elevated surfaced to the ground surface. In other words, the frame 100 does not require any additional apparatus for it to be loaded onto or unloaded from an elevated surface. At least one exemplary embodiment of apparatus 10 is designed to be used in conjunction with a standard-height and standard-width trailer (e.g., the trailer may have a height of about 30 inches to about 60 inches and a width of about 102 inches).

The frame 100 may be formed of one or more materials operable to support the one or more containers 50 loaded with bulk material. For example, the frame 100 may be formed of metals (e.g., steel, aluminum, etc.), polymers, fiber glass (e.g., extruded fiber glass), carbon fiber, etc. Many components of the frame 100 (e.g., the leg members 110, 112, 114, 116, cross members 150, etc.) are coupled together (e.g., fixedly coupled) such that the frame 100 forms a rigid, static, and stable structure. In at least one embodiment, the components of the frame 100 are constructed with heavy-duty, boxed-tube construction.

The leg members 110, 112, 114, 116 are spaced apart about a perimeter 16 (represented by a dotted line in FIG. 4) of the apparatus 10 to support the one or more containers 50. In at least one embodiment, the first and second leg members 110, 112 define a first frame plane along a first side 12 of the apparatus 10 and the third and fourth leg members 114, 116 define a second frame plane along a second side 14 of the apparatus 10 opposite the first side 12. As depicted, the first frame plane and the second frame plane may be parallel. In at least one embodiment, the distance between the first frame plane and the second frame plane is greater than 102 inches, e.g., such that a standard-width trailer may be locatable between the first frame plane and the second frame plane.

Each of the first, second, third, and fourth leg members 110, 112, 114, 116 may be substantially the same, and as such, depending on the context, only the first leg member 110 will be described in more detail hereinafter. Further, it is to be understood that any description of first leg member 110 applies to the other leg members 112, 114, 116. First leg member 110 includes an upper leg portion 120 and a lower leg portion 130.

The upper leg portion 120 extends from a bottom end region 122 to a top end region 124 along a vertical axis 121 (e.g., the vertical axis may be perpendicular to a surface when apparatus 10 is properly stationed on the surface). When the one or more containers 50 are assembled with the frame 100, the top end region 124 of the upper leg portion 120 is located adjacent the one or more containers 50. The top end region 124 of the upper leg portion 120 may be located anywhere proximate the one or more containers 50 so as to support the one or more containers 50.

Figure 3:
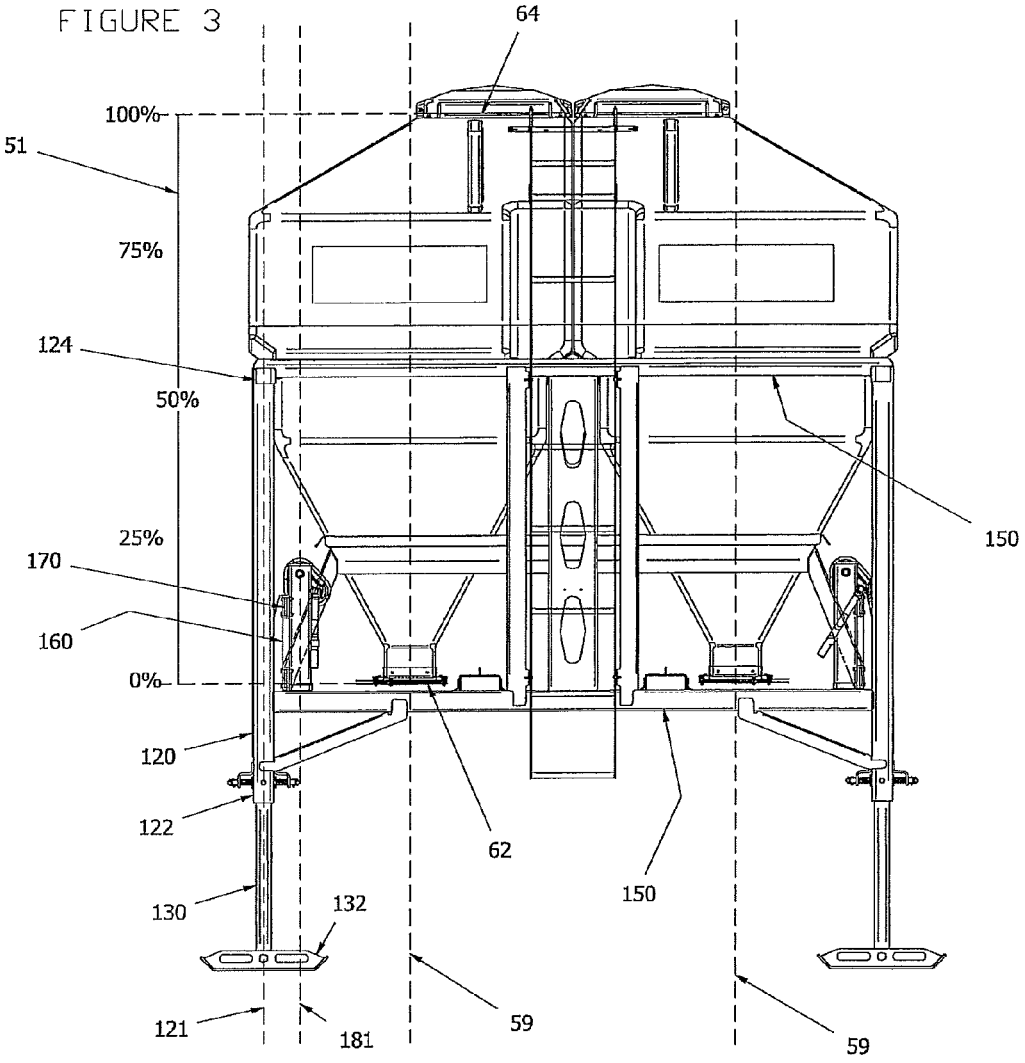
FIG. 3 is an illustrative left side view of the bulk material storage apparatus of FIG. 1.

As shown in FIG. 3, a height 51 of the one or more containers 50 may be defined from the bottom (e.g., the discharge opening 62) of the one or more containers 50 to the top (e.g., the load opening 64) of the one or more containers 50. As depicted, the top end region 124 of the upper leg portion 120 is located adjacent the one or more containers 50 at a position about 50 percent of the height 51 of the one or more containers 50 away from the bottom of the one or more containers 50. In other embodiments, the top end region 124 of the upper leg portion 120 may be located adjacent the one or more containers 50 between a position 25 percent of the height 51 of the one or more containers 50 away from the bottom of the one or more containers 50 and a position 75 percent of the height 51 of the one or more containers 50 away from the bottom of the one or more containers 50.

Figure 4:
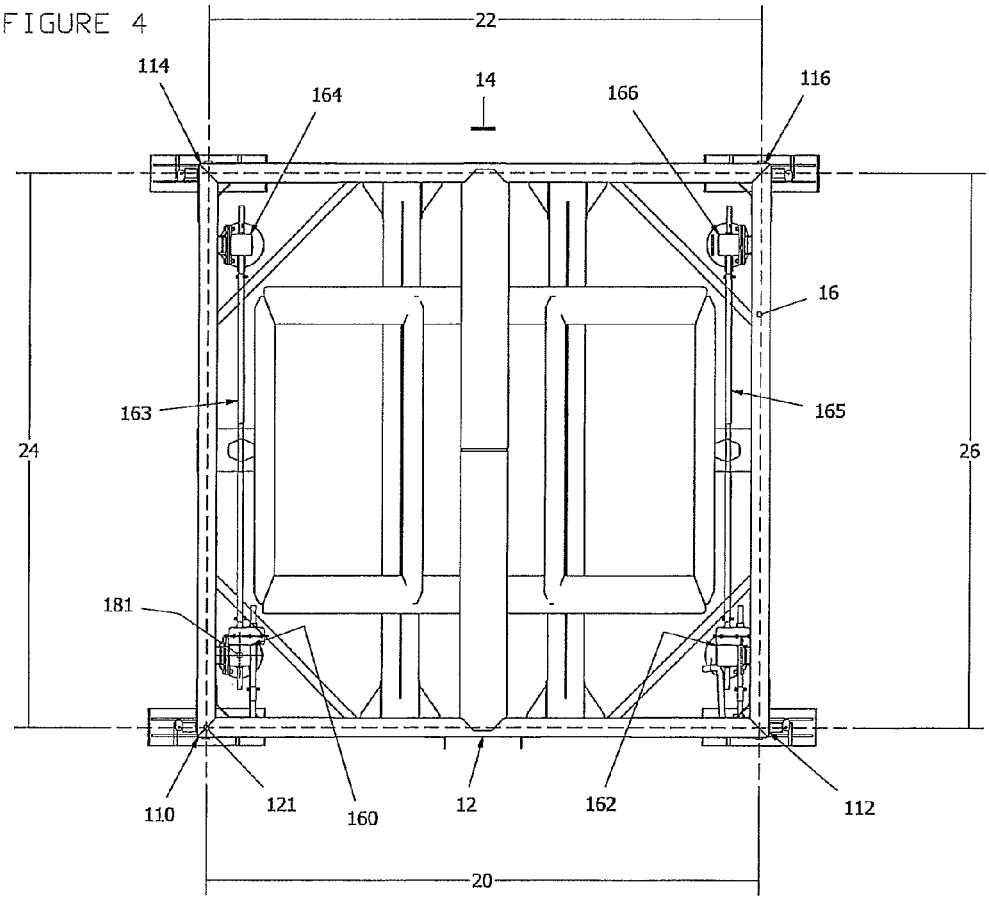
FIG. 4 is an illustrative top view of the bulk material storage apparatus of FIG. 1 without a container.

As shown in FIG. 4, the leg members 110, 112, 114, 116 may be spaced apart about the perimeter 16 such that a distance 20 between the first leg member 110 and the second leg member 112 is equal to a distance 22 between the third leg member 114 and the fourth leg member 116. Further, the leg members 110, 112, 114, 116 may be spaced apart about the perimeter 16 such that a distance 24 between the first leg member 110 and the third leg member 114 is equal to a distance 26 between the second leg member 112 and the fourth leg member 116. Still further, the leg members 110, 112, 114, 116 may be spaced apart about the perimeter 16 such that the distance 20 between the first leg member 110 and the second leg member 112 is equal to the distance 24 between the first leg member 110 and the third leg member 114. However, such spacing may depend on the cross-section of the one or more containers 50 supported, e.g., the cross-section of the one or more containers 50 may be rectangular, square, etc. Nonetheless, the leg members 110, 112, 114, 116 may be spaced in any configuration that provides a stable, rigid structure.

The lower leg portion 130 includes a foot member 132 operable to engage a surface. As depicted, the foot member 132 defines a flat shape for contacting a surface (e.g., a ground surface) and is coupled (e.g., pivotally coupled) to the lower leg portion 130 with a bolt. Further, the foot member 132 may be pivotable about an axis defined by the bolt by about 10 degrees in either direction (i.e., clockwise or counter-clockwise) from parallel to the ground surface to, e.g., conform to an uneven ground surface and distribute the forces transmitted down the lower leg portion 130 across the foot member 132. In other embodiments, the foot member 132 may define any shape operable to contact a surface and may be coupled to the lower leg portion 130 using any technique. For example, the foot member 132 may define a spherical shape and may be welded to the lower leg portion 130. Further, in at least one embodiment, the foot member 132 may include one or more lockable wheels.

The lower leg portion 130 is configured to move along the vertical axis 121, e.g., when the apparatus 10 is being unloaded from an elevated surface to a ground surface or loaded from a ground surface to an elevated surface as described in further detail herein with reference to FIGS. 7-8. To facilitate such movement, the lower leg portion 130 is adjustably coupled (e.g., in a telescoping configuration) to the bottom end region 122 of the upper leg portion 120 for adjustment along the vertical axis 121 between at least a retracted position and an extended position. When the lower leg portion 130 is in the extended position, the foot member 132 is located further away from the bottom end region 122 of the upper leg portion 120 than when the lower leg portion 130 is in the retracted position. In other words, the foot member 132 is located closer to the bottom end region 122 of the upper leg portion 120 when the lower leg portion 130 is in the retracted position than when the lower leg portion 130 is in the extended position.

Further, when the lower leg portion 130 is in the extended position, the foot member 132 is operable to engage a surface to support the apparatus 10 on the surface, e.g., when the apparatus 10 is being unloaded from an elevated surface to a ground surface. When the lower leg portion 130 is in the retracted position, the foot member 132 may be located above a surface so to be clear of the surface, e.g., when the apparatus 10 has been loaded onto an elevated surface (e.g., a trailer bed) for transportation.

Figure 5:
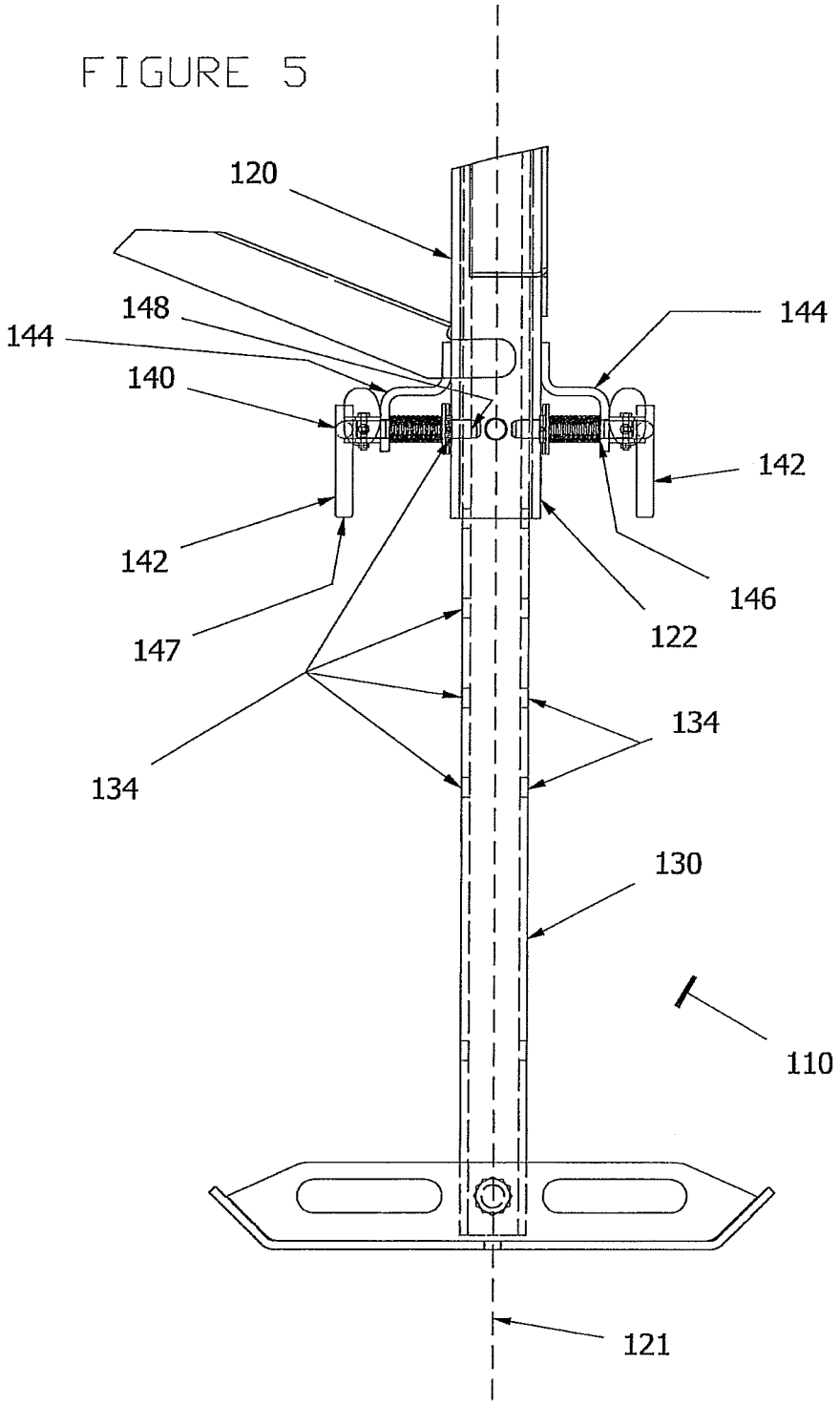
FIG. 5 is an enlarged side view of one embodiment of a locking structure of a leg member of the bulk material storage apparatus of FIG. 1.

As shown in detail in FIG. 5, first leg member 110 further includes a locking structure 140 located proximate the bottom end region 122 of the upper leg portion 120 to lock the lower leg portion 130 (e.g., in one of a plurality of positions) along the vertical axis 121 of the upper leg portion 120. As depicted, the lower leg portion 130 includes a plurality of apertures 134 located along the length of the lower leg portion 130 to be used in conjunction with the locking structure 140.

The locking structure 140 includes two release handles 142, each for engaging one of the plurality of apertures 134 of the lower leg portion 130 to lock the position of the lower leg portion 130 (e.g., in one of the plurality of positions) along the vertical axis 121.

The release handles 142 may be movably coupled to tab members 144 of the locking structure 140 that are coupled to and extend from the upper leg portion 120, and may be biased by, e.g., springs 146, to engage one of the plurality of apertures 134 of the lower leg portion 130 such that the release handles 142 may not unintentionally be disengaged from the apertures 142 of the lower leg portion 130. Further, the release handles 142 may extend from a proximal end 147 to a distal end 148. A user may grasp (and, e.g., pull back) the proximal ends 147 of the release handles 142 to release (e.g., un-lock) the lower leg portion 130 for movement about the vertical axis 121. The distal end 148 is the portion of the release handle 142 that engages the locking apertures 134 of the lower leg portion 130. After an operator has positioned lower leg portion 130 (e.g., in an advanced or non-advanced position), the operator may release handles 142 to re-lock the lower leg portion 130 in a fixed position. Further, as depicted, each release handle 142 may be configured to be retained in an un-locked position after a user has pulled back the release handle 142 such that a cam portion of the release handle 142 engages the tab member 144 to hold the release handle in the un-locked position.

It is to be understood that many other locking structures other than the locking structure 140 may be used to lock the leg portion of the leg members of the apparatus 10. For example, a locking structure including pins, screws, clamps, etc. may be used.

The frame 10 includes plurality of cross members 150 (e.g., two or more cross members). Each of the of cross members 150 extends from a first end region 152 to a second end region 154 and between two of the leg members 110, 112, 114, 116 to support the leg members 110, 112, 114, 116 as spaced apart about the perimeter 16 of the apparatus 10. Further, as depicted, each cross member 150 may extend along an axis that is perpendicular to the vertical axes of the upper leg portions of the leg members 110, 112, 114, 116. In other embodiments, each cross member 150 may not extend along an axis that is perpendicular to the vertical axes of the leg members 110, 112, 114, 116 (e.g., the cross members 150 may be arced members, truss-like structures, etc.). Further, also as depicted, more than one cross member 150 may extend between the same two leg members (e.g., one of the cross members 150 of two cross members coupled to the same two leg members may be located closer to the upper end regions of the same two leg members than the other cross member coupled to the same two leg members).

Figure 8A:
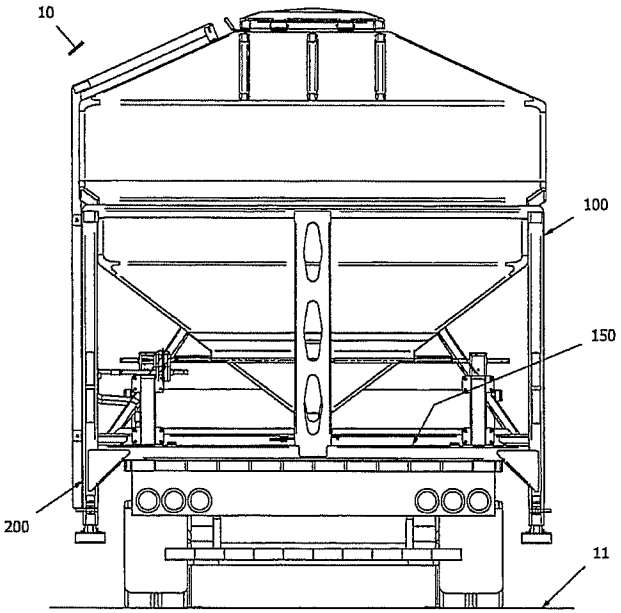
FIGS. 7A-7D and 8A-8D are illustrative left side views and rear side views, respectively, of the bulk material storage apparatus of FIG. 1 being unloaded from a trailer bed to a ground surface.

When the apparatus 10 is located on an elevated surface, at least a portion of the frame 100 engages the elevated surface to support the apparatus 10 thereon. In at least one embodiment, at least two cross members 150 may engage the elevated surface when the apparatus 10 is located on the elevated surface (e.g., a trailer bed as shown in FIG. 8A). To position the at least two cross members 150 in a location to engage to the elevated surface to support the apparatus 10 on the elevated surface, the at least two cross members are located closer to a plane defined by the lower end regions 122 of the upper leg portions 120 than the discharge opening 62 of the one or more containers 50 (e.g., in other words, the at least two cross members are located closer to a plane defined by the lower end regions 122 of the upper leg portions 120 than the lowermost portion of the one or more containers 50, or the at least two cross members are located closer to a plane defined by the lower end regions 122 of the upper leg portions 120 than the portion of the one or more containers 50 that is located closest to the plane defined by the lower end regions 122 of the upper leg portions 120). In at least one embodiment, at least two of the cross members 150 define a plane that is perpendicular to the first frame plane and second frame plane and is located closer to a plane defined by the lower end regions 122 of the upper leg portions 120 than the lowermost portion of the one or more containers 50.

The frame 100 may include additional support features to support the frame 100 such as, e.g., upright support members 151 extending between cross members 150, diagonal cross members 153 extending between cross members 150, leg support members 156 extending between a cross member 150 and an upper leg portion of one of the leg members 110, 112, 114, 116 (e.g., at a location closer to the lower end region 122 of the upper leg portion 120 than the upper end region 124, at a location closer to the lower end region 122 of the upper leg portion 120 than where the cross member 150 is coupled to the upper leg portion 120, etc.). In at least one embodiment, the leg support members 156 may be fixedly coupled to the cross member 150 and the upper leg portion of one of the leg members 110, 112, 114, 116. In other words, the leg support members 156 may be not be movable relative to the cross members and the upper portions of the leg members. As shown, the lower leg portions of the first, second, third, and fourth leg members 110, 112, 114, 116 do not require additional support members, e.g., support members similar to the leg support members 156 but extending between a lower leg portion and a cross member. In other words, the lower leg portions of the first, second, third, and fourth leg members 110, 112, 114, 116 are self-supporting.

Figure 2:
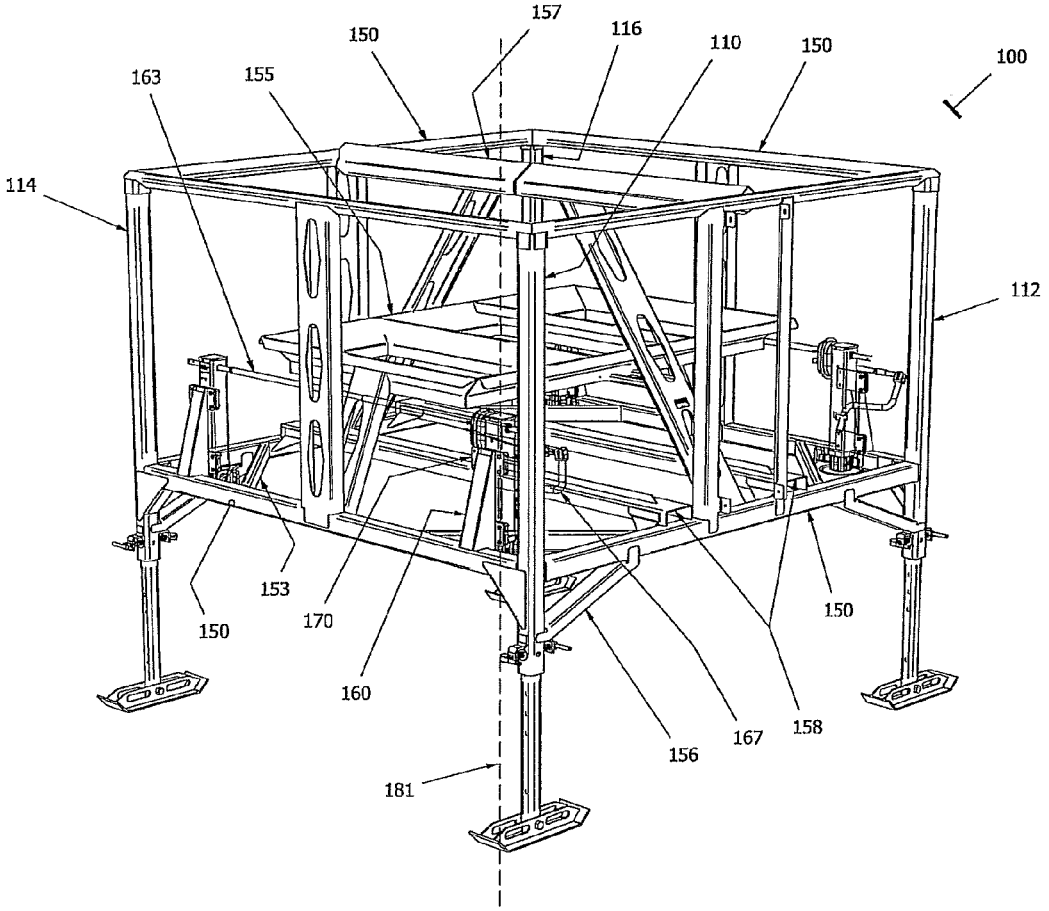
FIG. 2 is an illustrative perspective view of the bulk material storage apparatus of FIG. 1 without a storage container.

Further, the frame 100 may include additional functional features such as, e.g., fork lift support members 158 for engagement with a fork lift such that the apparatus 10 may be lifted by the fork lift, a ladder 159 for a user to utilize to climb up to the load opening 64, etc. Still further, as shown in FIG. 2, the frame 100 may include lower container support apparatus 155 to support the one or more containers 50 from the lower portions 52 of the one or more containers 50 and upper container support apparatus 157 to support the one or more containers 50 from the upper portions 54 of the one or more containers 50.

Each of the first, second, third, and fourth lift apparatuses 160, 162, 164, 166 may be substantially the same, and as such, depending on the context, only the first lift apparatus 160 will be described in more detail hereinafter. Further, it is to be understood that any description of first lift apparatus 160 applies to the other lift apparatus 162, 164, 166. As shown best in FIG. 6, first lift apparatus 160 includes a fixed portion 170 and a lift member 180.

Figure 6:
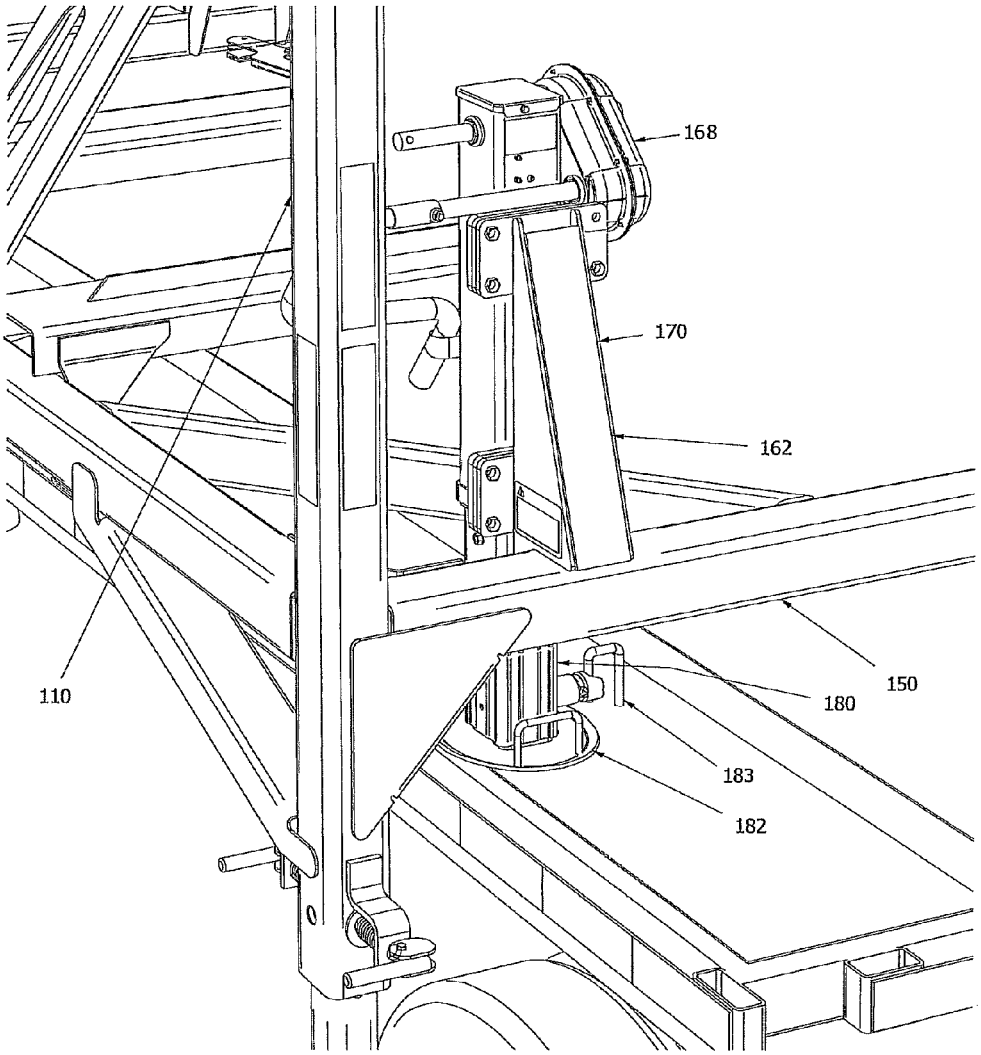
FIG. 6 is an enlarged view of one embodiment of a lifting apparatus of the bulk material storage apparatus of FIG. 1.

As shown in FIG. 6, the fixed portion 170 is coupled one of the plurality of cross members 150. However, the fixed portion 170 could be coupled to one of the upper leg portions of the leg members 110, 112, 114, 116. In other words, the fixed portion 170 may be coupled to at least one of the plurality of cross members 150 and the upper leg portions of the leg members 110, 112, 114, 116. Further, the fixed portions of the lift apparatuses 160, 162, 164, 166 are located proximate corresponding leg members of the leg members 110, 112, 114, 116. For example, the first lift apparatus 160 is coupled proximate the first leg member 110, the second lift apparatus 162 is coupled proximate the second leg member 112, the third lift apparatus 164 is coupled proximate the third leg member 114, and the fourth lift apparatus 166 is coupled proximate the fourth leg member 116. Further, the first lift apparatus 160 being coupled proximate the first leg member 110 refers to the first lift apparatus 160 being closer to the first leg member 110 than any of the other lift apparatuses 162, 164, 166 of the frame 100.

The fixed portion 170 is fixed relative to the upper leg portions of the leg members 110, 112, 114, 116 and the cross members 150 of the frame 100 (i.e., the fixed portion 170 does not move relative to the upper leg portions of the leg members 110, 112, 114, 116 and the cross members 150 of the frame 100).

The lift member 180 includes an engaging member 182 operable to engage an elevated surface (e.g., a trailer bed). As depicted, the engaging member 182 defines a round, flat surface with a beveled edge for contacting the elevated surface and is coupled to the lift member 180. In other embodiments, the engaging member 182 may define any shape operable to contact an elevated surface and may be coupled to the lift member 180 using any method.

The lift member 180 may be configured to move along a vertical axis 181, e.g., when the apparatus 10 is being unloaded from an elevated surface to a ground surface or loaded from a ground surface to an elevated surface as described in further detail herein with reference to FIGS. 7-8. To facilitate such movement, the lift member 180 is adjustably coupled to the fixed portion 170 for adjustment along the vertical axis 181 between at least a non-advanced position (e.g., a reversed position) and an advanced position. When the lift member 180 is in the non-advanced position, the engaging member 182 is located closer to the fixed portion 170 than when the lift member 180 is in the advanced position. Conversely, when the lift member 180 is in the advanced position, the engaging member 182 is located further away from the fixed portion 170 than when the lift member 180 is in the non-advanced position.

Further, when the lift member 180 is in the advanced position, the engaging member 182 is operable to engage an elevated surface to support the apparatus 10 on the elevated surface. When the lift member 180 is in the non-advanced position, the engaging member 182 may be located above an elevated surface so as to be clear of the elevated surface, e.g., when the apparatus 10 is being unloaded from the elevated surface to a ground surface.

Still further, the lift member 180 may include two portions that are adjustable coupled (e.g., in a telescoping configuration) to each other similar to the upper and lower leg portions of the leg members such that the lift member 180 is extendable, e.g., by about 1 inch to about 18 inches or more. Also, for example, as depicted in FIG. 6, a locking structure 183 may lock a first portion of the lift member 180 to a second portion of the lift member 180 similar to the locking structure 140 of the leg member 110.

Such that each lift member of the lift apparatus 160, 162, 164, 166 is located over an elevated surface when the apparatus 10 is being unloaded from the elevated surface or loaded onto the elevated surface, each lift member is located between the first frame plane and the second frame plane (i.e., between a plane defined by the first and second leg members 110, 112 and a plane defined by the third and fourth leg members 114, 116). At least in one embodiment, each lift member of the first, second, third, and fourth lift apparatuses 160, 162, 164, 166 is located between a plane defined by the first and third leg members 110, 114 and a plane defined by the second and fourth leg members 112, 116. Also, since the frame 100 is configured such that the first frame plane and the second frame plane can straddle an elevated surface (e.g., each frame plane lies on opposite sides of the elevated surface), the lift members may not lie in either of the first frame plane or the second frame plane. As such, the lift members of the lift apparatuses 160, 162, 164, 166 may be offset from one of the first frame plane and the second frame plane (e.g., such that they do not lie in either of the first frame plane or the second frame plane). In other words, the lift members of the lift apparatuses 160, 162, 164, 166 may be located a distance away from their respective proximate leg members about 25% or less of the distance between the proximate leg member and a leg member located on a same side of the apparatus 10 as the proximate leg member (e.g., the lift member 180 of the first lift apparatus 160 may be located a distance from first leg member 110 about 25% or less of the distance between first leg member 110 and the second leg member 112 and/or the third leg member 114). In another embodiment, the lift members of the lift apparatuses 160, 162, 164, 166 may be located a distance away from their respective proximate leg members about 45% or less of the distance between the proximate leg member and a leg member located on a same side of the apparatus 10 as the proximate leg member (e.g., the lift member 180 of the first lift apparatus 160 may be located a distance from first leg member 110 about 45% or less of the distance between first leg member 110 and the second leg member 112 and/or the third leg member 114). Another way of describing the location of the lift members of the lift apparatuses 160, 162, 164, 166 may be with reference to the discharge opening axes 59 of the one or more containers 50. For example, the lift members of the lift apparatuses 160, 162, 164, 166 may be located closer to the discharge opening axis 59 of their closest container 50 than their respective proximate leg members 110, 112, 114, 116 (e.g., the lift member of the lift apparatus 160 may be located closer to the discharge opening axis 59 of the closest container 50 than leg member 110).

Further, the lift apparatuses 160, 162, 164, 166 may be operably coupled to one another in various configurations to assist in lifting the apparatus 10 from an elevated surface. For example, two or more of the lift apparatuses 160, 162, 164, 166 may be operably coupled such that the lift members of the coupled lift apparatuses are adjusted simultaneously. As depicted, the first lift apparatus 160 is operably coupled to the third lift apparatus 164 such that the lift members of the first and third lift apparatuses 160, 164 are simultaneously adjustable, and the second lift apparatus 162 is operably coupled to the fourth lift apparatus 166 such that the lift members of the second and fourth lift apparatuses 162, 166 are simultaneously adjustable. Further as depicted, the first lift apparatus 160 is operably coupled to the third lift apparatus 164 by a coupling member 163 (e.g., a pipe or rod) and the second lift apparatus 162 is operably coupled to the fourth lift apparatus 166 by a coupling member 165 (e.g., a pipe or rod). Although the coupled members 163, 165 are depicted, other embodiments may use different coupling apparatus to couple the lift apparatuses. For example, two or more lift apparatuses may be coupled together using a chain, belt, pneumatic hose, hydraulic hose, electrical connection etc. In another embodiment, the first lift apparatus 160 is operably coupled to the second lift apparatus 162 such that the lift members of the first and second lift apparatuses 160, 162 are simultaneously adjustable, and the third lift apparatus 164 is operably coupled to the fourth lift apparatus 166 such that the lift members of the third and fourth lift apparatuses 164, 166 are simultaneously adjustable. Such coupling configurations of the lifting apparatuses may assist in stabilizing the apparatus 10 when being lifted from the elevated surface.

Each of the lift apparatuses 160, 162, 164, 166 may be, e.g., a mechanical jack, a hydraulic jack, a pneumatic jack, an air bag, an electric jack, etc. As depicted, the lift apparatuses 160, 162, 164, 166 are manually-operable operated by a human operator) mechanical jacks capable of generating, e.g., up to about 40,000 pounds of force. Further as depicted, a hand crank 167 is operably coupled to the first lift apparatus 160 through a two-speed gearbox 168 (e.g., as shown in FIG. 6) such that an operator can rotate the hand crank to raise and lower the lift member 180 of the first lift apparatus 160. The two-speed gearbox 168 may allow the lift apparatus to be cranked at one of two selectable speeds, e.g., a lower speed when lifting the apparatus 10, and a higher speed when moving the lift member 180 in position to lift the apparatus 10. Also, since the first lift apparatus 160 is operably coupled (e.g., using the coupling member 163) to the third lift apparatus 164, the hand crank 167 is, in effect, also operably coupled to the third lift apparatus 164 to raise and lower the lift member of the third lift apparatus 164 simultaneous to the lift member 180 of the first lifting apparatus 160. In other embodiments, the lift apparatuses 160, 162, 164, 166 may be driven by, e.g., hydraulic systems, pneumatic systems, electric systems, internal combustion systems, etc. In at least one embodiment, such drive systems may be coupled to a drive shaft of each lift apparatus 160, 162, 164, 166 (e.g., using a chuck).

Due to the adjustability of the lower leg portions of the first, second, third, and fourth leg members 110, 112, 114, 116 and the adjustability of the lift members of the lift apparatuses 160, 162, 164, 166, the bulk material storage apparatus 10 may be configurable into a plurality of different configurations and may be used in various methods. For example, the apparatus 10 may be configurable in at least a transport configuration, a first transition configuration, a second transition configuration, and a stationary configuration. Further, for example, the apparatus 10 may use the adjustability of the lower leg portions and lift members to be unloaded from an elevated surface to a ground surface and loaded from a ground surface to an elevated surface.

Such configurations and methods will be described herein with reference to

FIGS. 7-8. FIGS. 7A-7D and 8A-8D are illustrative left side views and rear side views, respectively, of the bulk material storage apparatus 10 of FIG. 1 being unloaded from a trailer bed 200 (e.g., a standard-width trailer bed) to a ground surface 11.

Figure 7A:
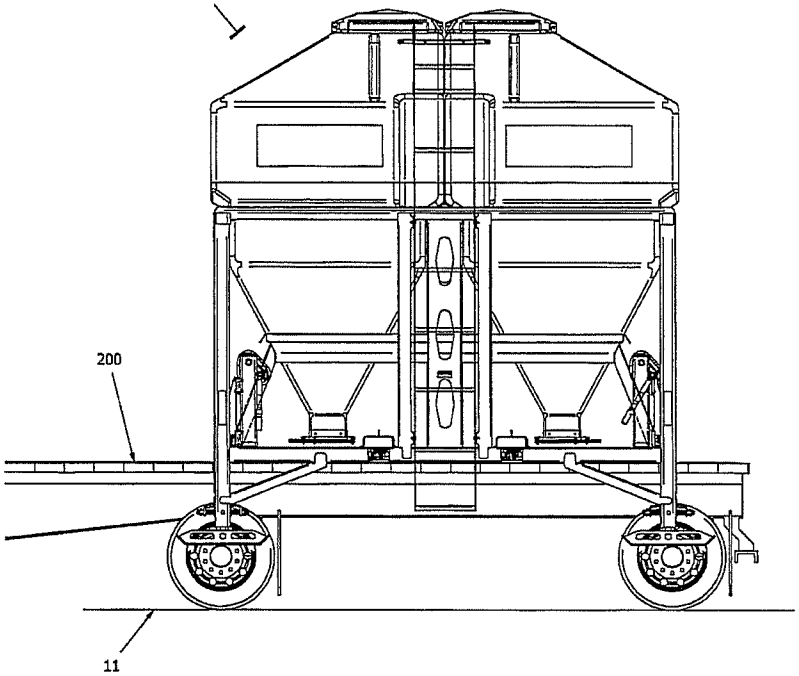

The transport configuration is depicted in FIGS. 7A and 8A with the bulk material storage apparatus 10 being provided on the trailer bed 200. More specifically, the lower leg portions of the first, second, third, and fourth leg members 110, 112, 114, 116 are in the retracted position such that the foot members are located above the ground surface 11 so to be clear of the ground surface 11. Further, the lift members of the first, second, third, and fourth lift apparatuses 160, 162, 164, 166 are in the non-advanced position such that the engaging members are located above the trailer bed 200 so to be clear of the trailer bed 200. In this configuration, at least a portion of the frame 100 is engaged with the trailer bed 200 to support the apparatus 10 on the trailer bed 200. As depicted, at least two cross members of the plurality of cross members 150 are engaged with the trailer bed 200 to support the apparatus 10 on the trailer bed 200 (e.g., two parallel cross members, each extending between two leg members along a plane defined by the two leg members). From the transport configuration, the bulk material storage apparatus 10 may, for example, be configured into the first transition configuration to start the process of unloading the apparatus 10 from the trailer bed 200.

Figure 8B:
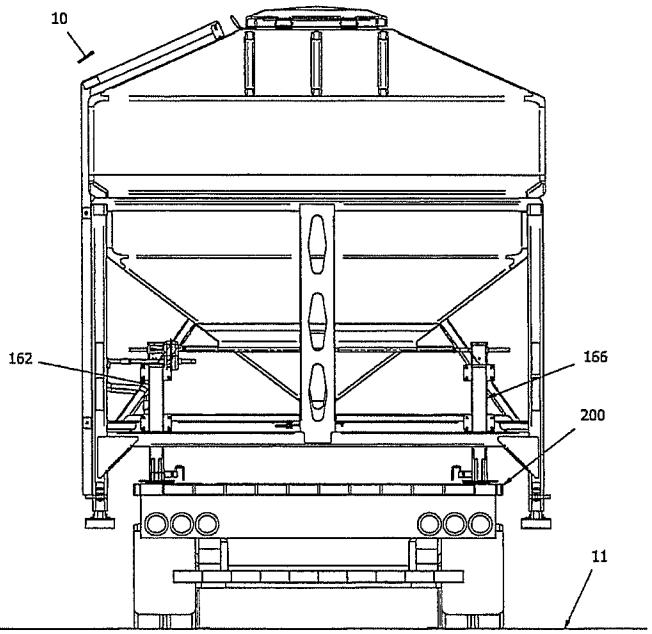
Figure 7B:
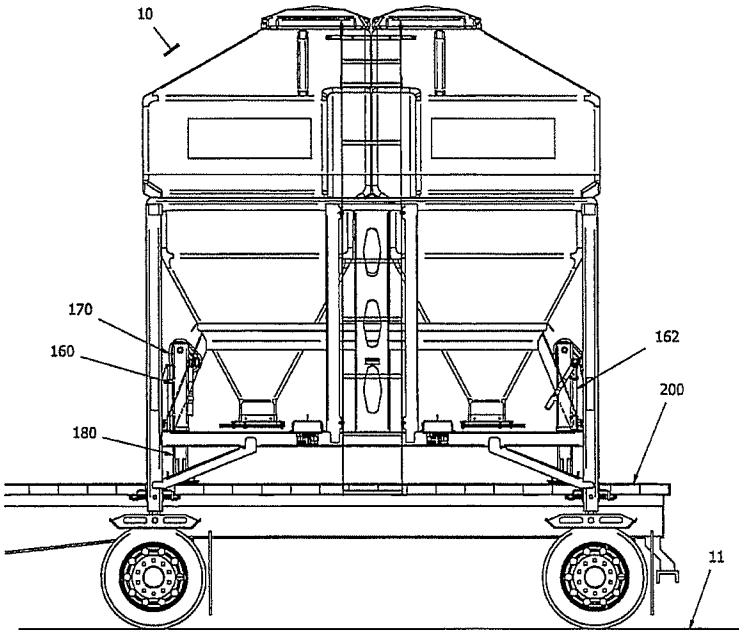

The bulk material storage apparatus is shown in the first transition configuration in FIGS. 7B and 8B. More specifically, while the lower leg portion of the first, second, third, and fourth leg members 110, 112, 114, 116 remain in the retracted position (as in the transport configuration as shown in FIGS. 7A and 8A), the lift members of the first, second, third, and fourth lift apparatuses 160, 162, 164, 166 are adjusted into the advanced position to engage the trailer bed 200 with the engaging members to support the apparatus 10 on the trailer bed 200. As described herein, the first lift apparatus 160 is operably coupled to the third lift apparatus 164 such that the lift members of the first and third lift apparatuses 160, 164 are simultaneously adjustable, and the second lift apparatus 162 is operably coupled to the fourth lift apparatus 166 such that the lift members of the second and fourth lift apparatuses 162, 166 are simultaneously adjustable. As such, the lifting members of the first and third lift apparatuses 160, 164 may be simultaneously adjusted into the advanced position before or after the lifting members of the second and fourth lift apparatuses 162, 166 are simultaneously adjusted into the advanced position. In other words, since the first and third lift apparatuses 160, 164 are located proximate the same side and the second and fourth lift apparatuses 162, 166 are located proximate the same side, one side of the apparatus 10 at a time may be lifted from the trailer bed 200 when the apparatus 10 is being configured into the first transition configuration.

Nonetheless, after the lift members of the first, second, third, and fourth lift apparatuses 160, 162, 164, 166 are adjusted into an advanced position, the apparatus 10 may be lifted from the trailer bed 200 and supported on the trailer bed 200 by the lift members such that the portion of the frame 100 that was previously engaged with the trailer bed 200 disengages from the trailer bed 200 as shown in FIGS. 7B and 8B. After the lift members of the first, second, third, and fourth lift apparatuses 160, 162, 164, 166 are adjusted into an advanced position and the remainder of the frame 10 has been disengaged from the trailer bed 200, the bulk material storage apparatus may be configured into the second transition configuration.

Figure 8C:
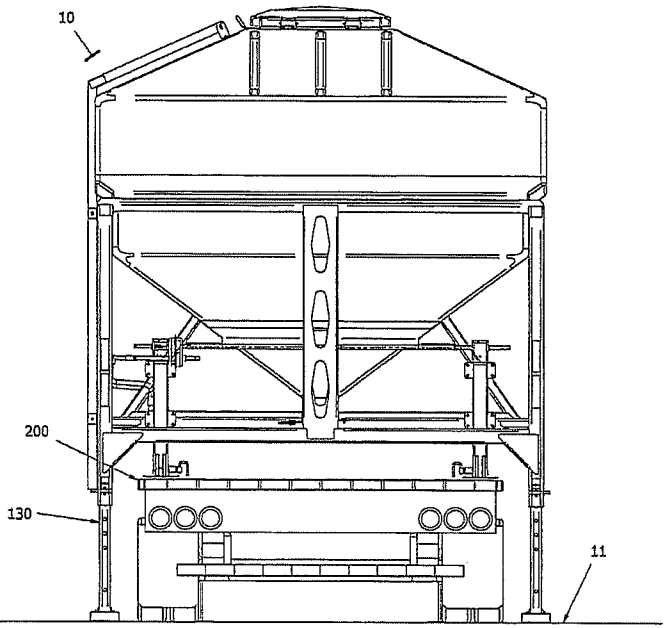
Figure 7C:
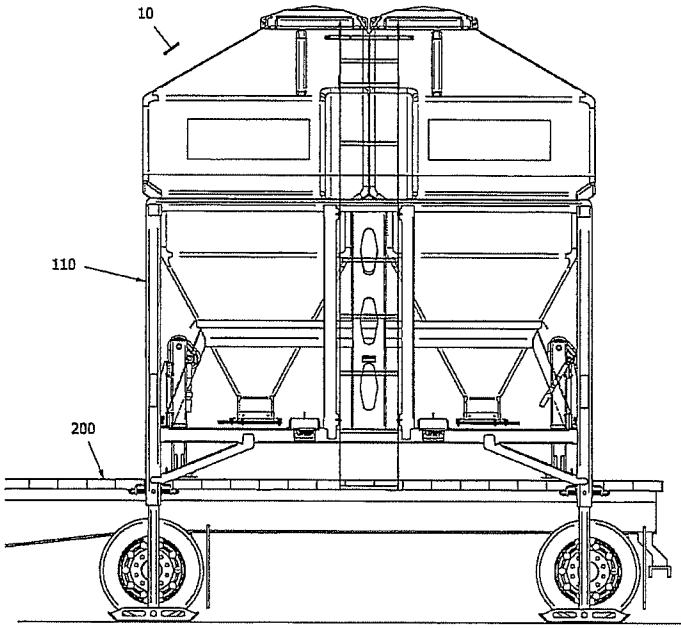

The bulk material storage apparatus is shown in the second transition configuration in FIGS. 7C and 8C. More specifically, the lift members of the first, second, third, and fourth lift apparatuses 160, 162, 164, 166 remain in the advanced position (as in the first transition configuration as shown in FIGS. 7B and 8B), and as such, are still engaging the trailer bed 200 with the engaging members to support the apparatus 10 on the trailer bed 200. However, the lower leg portions of the first, second, third, and fourth leg members 110, 112, 114, 116 are now adjusted into the extended position such that they are operable to engage the ground surface 11 with the foot members to support the apparatus 10 on the ground surface 11 when the frame 100 is lowered from the trailer bed 200 using the lift apparatuses 160, 162, 164, 166.

To adjust each of lower leg portions into the extended position, the release handles of the locking structure of the respective leg member may be moved and held open by an operator to disengage the release handles from the apertures of the lower leg portion of the respective leg member. Subsequently, the lower leg portion may be adjusted into the extended position and the operator may release the release handles to lock the lower leg portion into the extended position (e.g., the lower leg portions may be adjusted such that the foot member is located as close as possible to the ground surface 11). After the lower leg portions of the first, second, third, and fourth leg members 110, 112, 114, 116 have been adjusted into the extended position, the apparatus 10 may be ready to be lowered down onto the ground surface 11 such that the foot members of the lower leg portions engage the ground surface 11 to support the apparatus 10 on the ground surface 11.

To lower the apparatus 10 onto the ground surface 11, the lift members of the lift apparatuses 160, 162, 164, 166 may be adjusted into the non-advanced position. As described herein, the first lift apparatus 160 is operably coupled to the third lift apparatus 164 such that the lift members of the first and third lift apparatuses 160, 164 are simultaneously adjustable, and the second lift apparatus 162 is operably coupled to the fourth lift apparatus 166 such that the lift members of the second and fourth lift apparatuses 162, 166 are simultaneously adjustable. As such, the lifting members of the first and third lift apparatuses 160, 164 may be simultaneously adjusted into the non-advanced position before or after the lifting members of the second and fourth lift apparatuses 162, 166 is simultaneously adjusted into the non-advanced position. In other words, since the first and third lift apparatuses 160, 164 are located proximate the same side and the second and fourth lift apparatuses 162, 166 are located proximate the same side, one side of the apparatus 10 at a time may be lowered onto the ground surface 11. After both sides have been lowered onto the ground surface 11, the apparatus 10 may be configured into the stationary configuration.

Figures 7D, 8D:
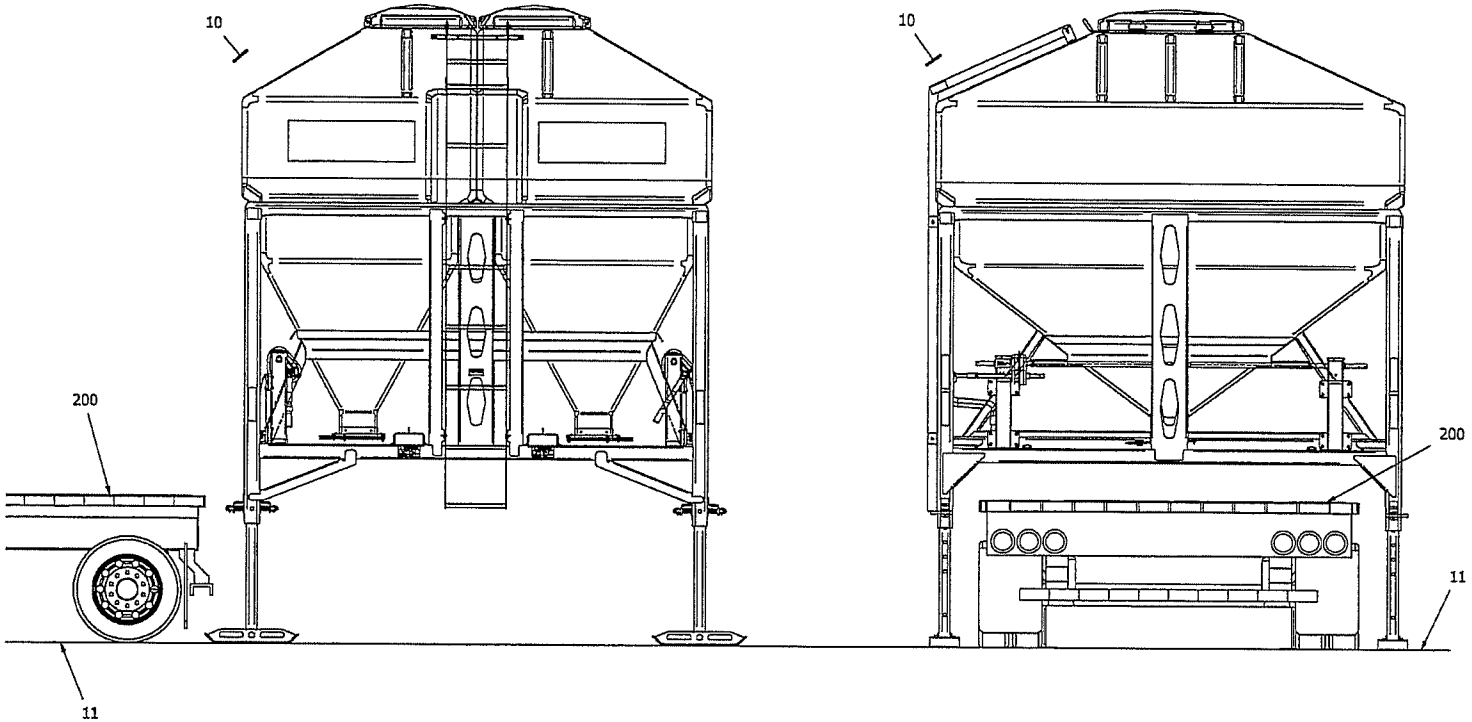

The bulk material storage apparatus is shown in the stationary configuration in FIGS. 7D and 8D. More specifically, the lower leg portions of the first, second, third, and fourth leg members 110, 112, 114, 116 remain in the extended position but the lift members of the first, second, third, and fourth lift apparatuses 160, 162, 164, 166 have been adjusted into the non-advanced position. As a result, the apparatus 10 has been lowered such that the foot members of the lower leg portions of the leg members 110, 112, 114, 116 are engaged with the ground surface 11 to support the apparatus 10 on the ground surface 11. Further, the lift members of the lift apparatuses 160, 162, 164, 166 are located above the trailer bed 200 so to be clear of the trailer bed 200 such that, e.g., as shown, the trailer bed 200 may be moved away from the apparatus 10 leaving the apparatus 10 stationed on the ground surface 11.

The method and configurations shown and described with reference to FIGS. 7A to 7D provide for unloading the apparatus 10 from a trailer bed 200 to a ground surface 11. Conversely, to load the apparatus 10 from the ground surface 11 onto the trailer bed 200, it is to be understood that the order of the method and the configurations may be reversed. For example, the apparatus 10 may be provided in a stationary configuration and the trailer bed 200 may be moved into a location between the first frame plane and second frame plane and underneath the one or more containers 50 such that the upper leg portions of the leg members are located alongside the trailer bed 200. Next, the apparatus 10 may be configured into the second transition configuration thereby lifting the apparatus 10 from the ground surface 11 to be supported on the trailer bed 200 by adjusting the lift members of the lifting apparatuses 160, 162, 164, 166. Next, the apparatus 10 may be configured into the first transition configuration by adjusting the lower leg portions of the leg members 110, 112, 114, 116 into the retracted position to clear the ground surface 11. And finally, the apparatus 10 may be configured into the transport configuration by lowering the frame 100 onto the trailer bed 200 such that at least a portion of frame 100 is engaging the trailer bed 200 to support the apparatus 10 on the trailer bed by adjusting the lift members of the lift apparatus 160, 162, 164, 166 into the non-advanced position.

Although the methods and configurations have been described herein with reference to a trailer bed, such methods and configurations may be usable with any elevated surface, e.g., an elevated surface of a seed tender, a truck bed, a train bed, a concrete platform, a loading dock, etc.

Any features, components, and/or properties of any of the embodiments described herein may be incorporated into any other embodiment(s) described herein.

All patents, patent documents, and references cited herein are incorporated in their entirety as if each were incorporated separately. This disclosure has been provided with reference to illustrative embodiments and is not meant to be construed in a limiting sense. As described previously, one skilled in the art will recognize that other various illustrative applications may use the techniques as described herein to take advantage of the beneficial characteristics of the apparatus and methods described herein. Various modifications of the illustrative embodiments, as well as additional embodiments of the disclosure, will be apparent upon reference to this description.

The invention claimed is:

1. A bulk material storage apparatus operable to be transported on a trailer bed and stationed on a ground surface, wherein the apparatus comprises:

one or more containers, wherein each of the one or more containers defines a volume for holding a bulk material; and a frame to support the one or more containers and defining a first frame plane along a first side of the apparatus and a second frame plane along a second side of the apparatus opposite the first side of the apparatus, wherein the frame comprises:

at least two leg members spaced apart about a perimeter of the apparatus, wherein each of the at least two leg members comprises:

an upper leg portion extending from a bottom end region to a top end region along a vertical axis, wherein the top end region is located adjacent the one or more containers, and a lower leg portion comprising a foot member operable to engage the ground surface, wherein the lower leg portion is adjustably coupled to the bottom end region of the upper leg portion for adjustment along the vertical axis between at least a retracted position and an extended position, wherein the foot member is operable to engage the ground surface to support the apparatus on the ground surface when the lower leg portion is in the extended position, wherein the foot member is located closer to the bottom end region of the upper leg portion when the lower leg portion is in the retracted position than when the lower leg portion is in the extended position, a plurality of cross members configured to support the at least two leg members as spaced apart about the perimeter of the apparatus, and at least two lift apparatuses, wherein each of the at least two lift apparatuses comprises:

a fixed portion fixedly attached to at least one of the plurality of cross members and the upper leg portions of the at least two leg members, and a lift member comprising an engaging member operable to engage the trailer bed, wherein the lift member is adjustably coupled to the fixed portion for adjustment along a vertical axis between at least a non-advanced position and an advanced position, wherein the engaging member engages the trailer bed to support the apparatus on the trailer bed when the lift member is in the advanced position, wherein the lift member is offset from one of and located between the first frame plane and the second frame plane, wherein the apparatus is configurable in at least a transport configuration, a first transition configuration, a second transition configuration, and a stationary configuration, wherein the lower leg portion of each of the at least two leg members is in the retracted position, the lift member of each of the at least two lift apparatuses is in the non-advanced position, and at least a portion of the frame is operable to engage the trailer bed to support the apparatus on the trailer bed when the apparatus is in the transport configuration, wherein the lower leg portion of each of the at least two leg members is in the retracted position and the lift member of each of the at least two lift apparatuses is in the advanced position operable to engage the trailer bed with the engaging member to support the apparatus on the trailer bed when the apparatus is in the first transition configuration, wherein the lower leg portion of each of the at least two leg members is in the extended position operable to engage the ground surface with the foot member to support the apparatus on the ground surface and the lift member of each of the at least two lift apparatuses is in the advanced position operable to engage the trailer bed with the engaging member to support the apparatus on the trailer bed when the apparatus is in the second transition configuration, and wherein the lower leg portion of each of the at least two leg members is in the extended position operable to engage the ground surface with the foot member to support the apparatus on the ground surface and the lift member of each of the at least two lift apparatuses is in the non-advanced position when the apparatus is in the stationary configuration.

2. The apparatus of claim 1, wherein a distance between the first frame plane and the second frame plane is greater than 102 inches.

3. The apparatus of claim 1, wherein two of the at least two lift apparatuses are operably coupled to each other such that the lift members of the two lift apparatuses are simultaneously adjustable.

4. The apparatus of claim 1, wherein each of the plurality of cross members extends along an axis that is perpendicular to the vertical axes of the upper leg portions of the at least two leg members.

5. The apparatus of claim 1, wherein each of the one or more containers further comprises:

a load opening for loading the bulk material into the volume, a lid member for selectively covering the load opening of the container, a discharge opening for discharging the bulk material from the volume, and a gate member for selectively closing the discharge opening of the container.

6. The apparatus of claim 1, wherein the frame further defines a third frame plane along a third side of the apparatus and a fourth frame plane along a fourth side of the apparatus opposite the third side of the apparatus, wherein the third frame plane and the fourth frame plane are perpendicular to the first and the second frame planes, wherein the lift member of at least one lift apparatus of the at least two lift apparatuses is offset from the third frame plane and wherein the lift member of at least one lift apparatus of the at least two lift apparatuses is offset from the fourth frame plane.

7. The apparatus of claim 1, wherein at least one of the at least two leg members further comprise a locking structure, wherein the locking structure is located proximate the bottom end region of the upper leg portion to lock the lower leg portion in one of a plurality of positions along the vertical axis of the upper leg portion.

8. The apparatus of claim 1, wherein at least one of at least two lift apparatuses comprises a manually-operable jack.

9. A storage apparatus for use with one or more containers comprising:

a frame to support the one or more containers and defining a first frame plane along a first side of the apparatus and a second frame plane along a second side of the apparatus opposite the first side of the apparatus, wherein the frame comprises:

at least two leg members spaced apart about a perimeter of the apparatus, wherein each of the at least two leg members comprises:

an upper leg portion extending from a bottom end region to a top end region along a vertical axis, wherein the top end region is located adjacent the one or more containers, and a lower leg portion comprising a foot member operable to engage the ground surface, wherein the lower leg portion is adjustably coupled to the bottom end region of the upper leg portion for adjustment along the vertical axis between at least a retracted position and an extended position, wherein the foot member is operable to engage the ground surface to support the apparatus on the ground surface when the lower leg portion is in the extended position, wherein the foot member is located closer to the bottom end region of the upper leg portion when the lower leg portion is in the retracted position than when the lower leg portion is in the extended position, a plurality of cross members configured to support the at least two leg members as spaced apart about the perimeter of the apparatus; and at least two lift apparatuses, wherein each of the at least two lift apparatuses comprises:

a fixed portion fixedly attached to at least one of the plurality of cross members and the upper leg portions of the at least two leg members, and a lift member comprising an engaging member operable to engage the trailer bed, wherein the lift member is adjustably coupled to the fixed portion for adjustment along a vertical axis between at least a non-advanced position and an advanced position, wherein the engaging member engages the trailer bed to support the apparatus on the trailer bed when the lift member is in the advanced position, wherein the lift member is offset from one of and located between the first frame plane and the second frame plane.

10. The apparatus of claim 9, wherein a distance between the first frame plane and the second frame plane is greater than 102 inches.

11. The apparatus of claim 9, wherein two of the at least two lift apparatuses are operably coupled to each other such that the lift members of the two lift apparatuses are simultaneously adjustable.

12. The apparatus of claim 9, wherein the frame further defines a third frame plane along a third side of the apparatus and a fourth frame plane along a fourth side of the apparatus opposite the third side of the apparatus, wherein the third frame plane and the fourth frame plane are perpendicular to the first and the second frame planes, wherein the lift member of at least one lift apparatus of the at least two lift apparatuses is offset from the third frame plane and wherein the lift member of at least one lift apparatus of the at least two lift apparatuses is offset from the fourth frame plane.

13. The apparatus of claim 9, wherein at least one of the at least two leg members further comprise a locking structure, wherein the locking structure is located proximate the bottom end region of the upper leg portion to lock the lower leg portion in one of a plurality of positions along the vertical axis of the upper leg portion.

14. A storage apparatus for use with one or more containers comprising:

a frame to support the one or more containers and defining a first frame plane along a first side of the apparatus and a second frame plane along a second side of the apparatus opposite the first side of the apparatus, wherein the frame comprises:

at least two leg members spaced apart about a perimeter of the apparatus, wherein each of the at least two leg members comprises:

an upper leg portion extending from a bottom end region to a top end region along a vertical axis, wherein the top end region is located adjacent the one or more containers, and a lower leg portion comprising a foot member operable to engage the ground surface, wherein the lower leg portion is adjustably coupled to the bottom end region of the upper leg portion for adjustment along the vertical axis between at least a retracted position and an extended position, wherein the foot member is operable to engage the ground surface to support the apparatus on the ground surface when the lower leg portion is in the extended position, wherein the foot member is located closer to the bottom end region of the upper leg portion when the lower leg portion is in the retracted position than when the lower leg portion is in the extended position, at least one cross member configured to support the at least two leg members as spaced apart about the perimeter of the apparatus; and at least one lift apparatus comprising:

a fixed portion fixedly attached to at least one of the at least one cross member and the upper leg portions of the at least two leg members, and a lift member comprising an engaging member operable to engage the trailer bed, wherein the lift member is adjustably coupled to the fixed portion for adjustment along a vertical axis between at least a non-advanced position and an advanced position, wherein the engaging member engages the trailer bed to support the apparatus on the trailer bed when the lift member is in the advanced position, wherein the lift member is offset from one of and located between the first frame plane and the second frame plane.

15. The apparatus of claim 14, wherein a distance between the first frame plane and the second frame plane is greater than 102 inches.

16. The apparatus of claim 14, wherein the frame further defines a third frame plane along a third side of the apparatus and a fourth frame plane along a fourth side of the apparatus opposite the third side of the apparatus, wherein the third frame plane and the fourth frame plane are perpendicular to the first and the second frame planes, wherein the lift member of the at least one lift apparatus is offset from one of the third frame plane and the fourth frame plane.

17. The apparatus of claim 14, wherein at least one of the at least two leg members further comprise a locking structure, wherein the locking structure is located proximate the bottom end region of the upper leg portion to lock the lower leg portion in one of a plurality of positions along the vertical axis of the upper leg portion.

* * * * *